US011066960B2

(12) United States Patent
Zhang

(10) Patent No.: US 11,066,960 B2
(45) Date of Patent: Jul. 20, 2021

(54) DOUBLE-REHEAT POWER GENERATOR WITH AN ULTRA HIGH PRESSURE CYLINDER AND A HIGH-INTERMEDIATE PRESSURE CYLINDER EACH HAVING ADDITIONAL HEAT RECOVERY TURBINE STAGES

(71) Applicant: Lidao Zhang, Shandong (CN)

(72) Inventor: Lidao Zhang, Shandong (CN)

( * ) Notice: Subject to any disclaimer, the term of this patent is extended or adjusted under 35 U.S.C. 154(b) by 0 days.

(21) Appl. No.: 17/038,047

(22) Filed: Sep. 30, 2020

(65) Prior Publication Data

US 2021/0140347 A1 May 13, 2021

Related U.S. Application Data

(63) Continuation of application No. PCT/CN2019/000072, filed on Apr. 16, 2019.

(51) Int. Cl.

| | |
|---|---|
| ***F01K 7/38*** | (2006.01) |
| ***F01D 15/10*** | (2006.01) |
| ***F01K 7/22*** | (2006.01) |
| ***F01K 7/40*** | (2006.01) |
| ***F01K 11/02*** | (2006.01) |
| ***F01K 17/00*** | (2006.01) |

(52) U.S. Cl.

CPC ..... *F01K 7/38* (2013.01); *F01D 15/10* (2013.01); *F01K 7/22* (2013.01); *F01K 7/40* (2013.01); *F01K 11/02* (2013.01); *F01K 17/00* (2013.01)

(58) Field of Classification Search

CPC . F01K 7/38; F01K 17/00; F01K 11/02; F01K 7/22; F01K 7/40; F01D 15/10

USPC ..... 60/653, 654, 677–680

See application file for complete search history.

(56) References Cited

U.S. PATENT DOCUMENTS

| | | | | |
|---|---|---|---|---|
| 8,661,821 | B2 * | 3/2014 | Zhao | F01K 17/06 60/653 |
| 2011/0214427 | A1 * | 9/2011 | Zhao | F01K 17/06 60/653 |
| 2014/0208747 | A1 | 7/2014 | Datye | |
| 2015/0059343 | A1 | 3/2015 | Hernandez Sanchez et al. | |

(Continued)

FOREIGN PATENT DOCUMENTS

| | | | |
|---|---|---|---|
| CN | 102486308 | A | 6/2012 |
| CN | 103670550 | A | 3/2014 |
| CN | 104806308 | A | 7/2015 |

(Continued)

*Primary Examiner* — Hoang M Nguyen

(57) ABSTRACT

A double-reheat power generator with an ultra high pressure cylinder and a high-intermediate pressure cylinder each having additional heat recovery turbine stages, including steam exhaust of the ultra high pressure cylinder having additional heat recovery turbine stages, that is, first extraction supplies steam to a first high-pressure heater. New second, new third and new fourth extractions of the ultra high pressure cylinder having additional heat recovery turbine stages supply steam to second, third and fourth high-pressure heaters respectively; a new fifth extraction of the HP-IP cylinder having additional heat recovery turbine stages supplies steam to a deaerator; a new sixth extraction of the HP-IP cylinder having additional heat recovery turbine stages supplies steam to an air-preheater; and an air-preheater drainage pump used for water draining of the air-preheater connects to the deaerator.

5 Claims, 1 Drawing Sheet

(56) References Cited

U.S. PATENT DOCUMENTS

| | | | | |
|---|---|---|---|---|
| 2016/0091197 | A1* | 3/2016 | Nagano | F23L 15/02<br>122/441 |
| 2019/0170020 | A1* | 6/2019 | Zhang | G21C 1/04 |

FOREIGN PATENT DOCUMENTS

| | | | |
|---|---|---|---|
| CN | 102486308 | B | 7/2016 |
| CN | 108643980 | | 10/2018 |

* cited by examiner

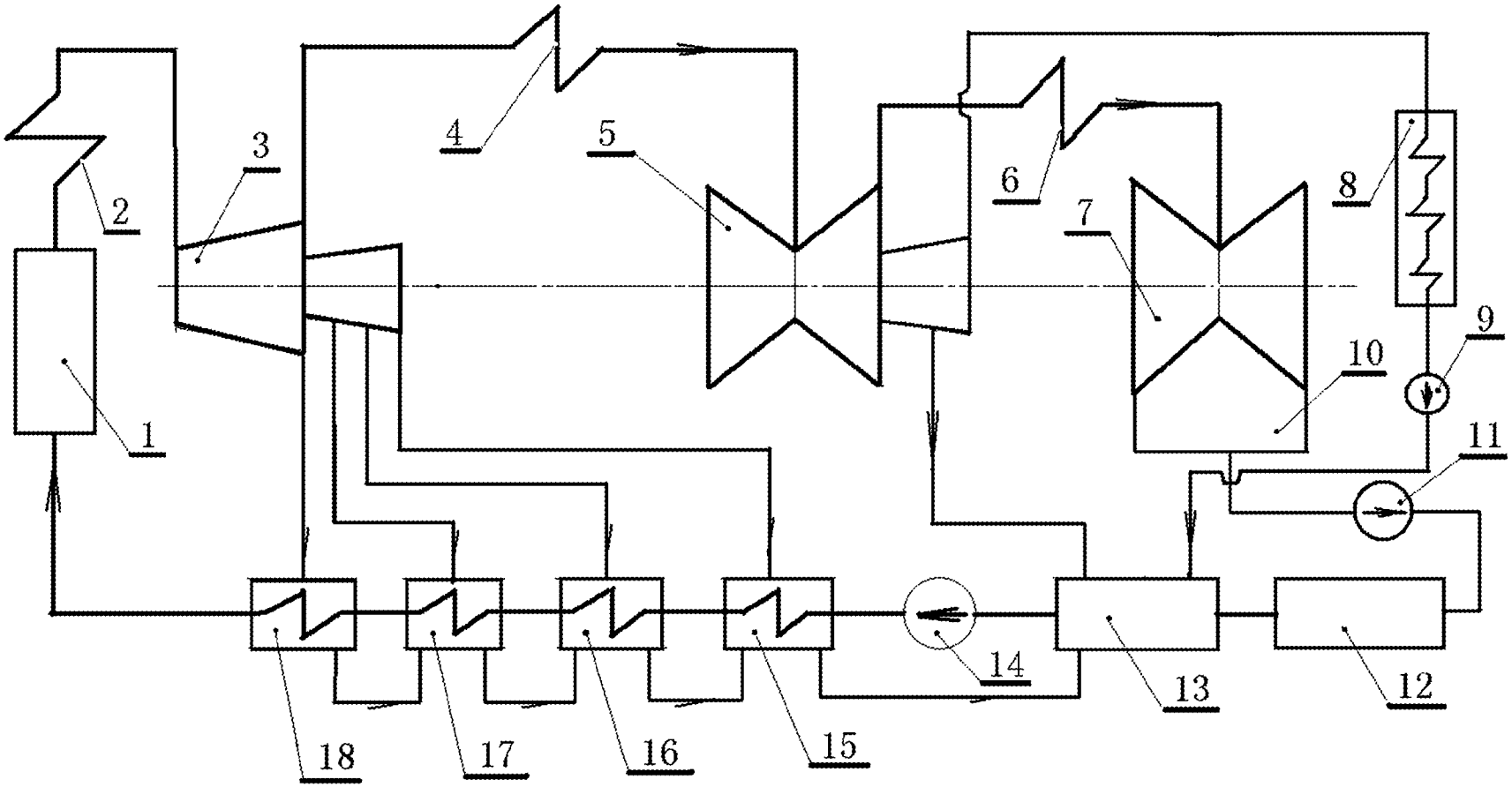
1
2
3
4
5
6
7
8
9
10
11
12
13
14
15
16
17
18

DOUBLE-REHEAT POWER GENERATOR WITH AN ULTRA HIGH PRESSURE CYLINDER AND A HIGH-INTERMEDIATE PRESSURE CYLINDER EACH HAVING ADDITIONAL HEAT RECOVERY TURBINE STAGES

CROSS-REFERENCE TO RELATED APPLICATIONS

This application is a continuation of International Patent Application No. PCT/CN2019/000072, filed on Apr. 16, 2019, which claims the benefit of priority from Chinese Patent Application No. 201810341162.X, filed on Apr. 17, 2018. The content of the aforementioned applications, including any intervening amendments thereto, is incorporated herein by reference in its entirety.

TECHNICAL FIELD

The present application relates to a double-reheat power generator with an ultra high pressure cylinder and a high-intermediate pressure cylinder each having additional heat recovery turbine stages which is an ultra-supercritical coal-fired double reheat unit with an ultra high pressure cylinder and a high-intermediate pressure cylinder each having additional heat recovery turbine stages; a heat recovery system thereof is optimized, and parameters of main steam, primary reheat steam and secondary reheat steam are further optimized; and the ultra-supercritical coal-fired double reheat unit can significantly reduce the heat consumption and greenhouse gas emissions.

BACKGROUND

For a typical turbine side of the existing double-reheat steam turbine generator, design values of a main steam temperature, a primary reheat steam temperature, a secondary reheat steam temperature at the turbine side are 600° C., 620° C. and 620° C., respectively, and design values of a main steam pressure, a primary reheat steam pressure, a secondary reheat steam pressure are 33.4 MPa, 10.3 MPa and 3.3 MPa. The double-reheat steam turbine generator generally includes an ultra high pressure cylinder, a high pressure cylinder, an intermediate pressure cylinder, low pressure cylinders which are coaxially arranged and other auxiliary equipment. There is a double shaft double generator arranged in a way that the ultra high pressure cylinder and the high pressure cylinder are arranged higher than the intermediate pressure cylinder and the low pressure cylinder; a primary reheater is arranged between an exhaust hood of the ultra high pressure cylinder and a primary reheat combined steam valve of the high pressure cylinder; a secondary reheater is arranged between an exhaust hood of the high pressure cylinder and a secondary reheat combined steam valve of the intermediate pressure cylinder; and an intermediate-low pressure connecting pipe is arranged between an exhaust hood of the intermediate pressure cylinder and a steam inlet of the low pressure cylinder to connect them.

It is recognized that in an ideal feedwater heat recovery system, there are more heat recovery stages, smaller pressure drop in an extraction pipe, smaller heater end difference and higher feedwater temperature; and the full use of extraction steam with a relatively lower pressure can increase a heat recovery work ratio and reduce the heat consumption of the turbine generator. A typical secondary reheat feedwater heat recovery system is provided with 4 or 5 high pressure heaters and 2 or 3 separate steam coolers, and its boiler feedwater temperature can reach 330° C.

Inlet steam temperatures of the high pressure cylinder and the intermediate pressure cylinder of the existing ultra-supercritical double-reheat power generator are as high as 620° C. An enthalpy value of a second extraction (i.e., a front stage extraction steam of the high pressure cylinder) is increased, and a temperature of the second extraction can be above 540° C. A temperature of a third extraction (i.e., a rear stage extraction steam) also can be above 510° C. A temperature of a fourth extraction (i.e., exhaust steam of the high pressure cylinder) is 434° C. A temperature of a fifth extraction (a front stage extraction steam of the intermediate pressure cylinder) is as high as 545° C. A temperature of a sixth extraction (i.e., a rear stage extraction steam of the intermediate pressure cylinder) used by a deaerator is still up to 432° C., even the temperature and the pressure of the sixth extraction are required to be reduced using a special temperature and pressure reducer before the sixth extraction is sent to the deaerator. Heat recovery work ratios of the second extraction, the third extraction, the fourth extraction, the fifth extraction and the sixth extraction decrease sharply, however, if extraction steam of the high pressure cylinder and the intermediate pressure cylinder that has a high value of enthalpy and a high degree of superheat is used to heat the feedwater, the exergy loss in the feedwater heat recovery process is significantly increased and thus the heat consumption of the turbine generator is increased.

The reheat temperature gradually rises from 535° C. for a subcritical turbine generator to 620° C. for a high-efficiency ultra-supercritical turbine generator, that is, primary reheat is evolved to secondary reheat, so the increased exergy loss in the feedwater heat recovery process becomes increasingly problematic. If there is no improvement or optimization, a turbine generator of 700° C./720° C. and 700° C./720° C./720° C. will be involved, which will worsen the energy-saving effect brought by high parameters and secondary reheat.

The high pressure heater used in the existing double-reheat steam turbine generator plays a key role in the feedwater heat recovery system. A typical high pressure heater can be a horizontal heat transfer tube, a U-shaped heat transfer tube or a shell and tube heat exchanger. A set of U-shaped heat transfer tubes usually has three parts: a superheated steam cooling zone, a condensation heat release zone and a drainage cooling zone. Tube sides of four or five high pressure heaters are arranged in series, specifically, an outlet of the feedwater pump is connected to a tube side inlet of a fifth high pressure heater, and a tube side outlet of the fifth high pressure heater is connected to a tube side inlet of a fourth high pressure heater, and a tube side outlet of the fourth pressure heater is connected to a tube side inlet of a third pressure heater, and a tube side outlet of the third pressure heater is connected to a tube side inlet of a second pressure heater, and a tube side outlet of the second pressure heater is connected to a tube side inlet of a first pressure heater, and a tube side outlet of the first pressure heater is connected to a tube side inlet of the separate steam cooler, and a tube side outlet of the separate steam cooler is connected to an inlet of an economizer of a double-reheat boiler. A shell side of a first high pressure heater receives the exhaust steam (the first extraction) of the super high pressure cylinder of the steam turbine. The front stage extraction steam (the second extraction) of the high pressure cylinder is pre-cooled on a shell side of the separate steam cooler (the second extraction), and then enters a second high pressure heater at its shell side. A rear stage extraction steam (the third extraction) of the high pressure cylinder is pre-cooled on a shell side of the separate steam cooler (the third extraction), and then enters a third high pressure heater at its shell side. A shell side of a fourth high pressure heater receives the exhaust steam (the fourth extraction) of the high pressure cylinder. A front stage extraction steam (the fifth extraction) of the intermediate pressure cylinder is pre-cooled on the shell side of the separate steam cooler (the fifth extraction), and then enters a fifth high pressure heater at its shell side. The feedwater in the fifth high pressure heater is heated to its saturation temperature under a pressure of the fifth extraction. The feedwater in the fourth high pressure heater is heated to its saturation temperature under a pressure of the fourth extraction. The feedwater in the third high pressure heater is heated to its saturation temperature under a pressure of the third extraction. The feedwater in the second high pressure heater is heated to its saturation temperature under a pressure of the second extraction. The feedwater in the first high pressure heater is heated to its saturation temperature under a pressure of the first extraction. A temperature of the feedwater in the separate steam cooler increases by 8-11K. The drainage of the high pressure heater flows back step by step. The drainage of the first high pressure heater flows back to the shell side of the second high pressure heater. The drainage of the second high pressure heater flows back to the shell side of the third high pressure heater. The drainage of the third high pressure heater flows back to the shell side of the fourth high pressure heater. The drainage of the fourth high pressure heater flows back to the shell side of the fifth high pressure heater. The drainage of the fifth high pressure heater flows back to the deaerator.

In the existing double-reheat steam turbine generator, the first high pressure heater usually has the highest feedwater enthalpy rise, the largest heat exchange area, and the most condensed steam. That is because the first extraction has a largest heat recovery work ratio compared with the second, third, fourth, fifth and sixth extractions. The full use of the first extraction benefits the existing feedwater heat recovery system from a thermal economy perspective.

The existing double-reheat steam turbine generator generally provides 9-10 stage extraction steams at different pressures, which matches the number of the high pressure heater, the deaerator, the low pressure heater configured in the turbine generator.

The sixth, seventh, eighth, ninth and tenth extractions used for condensate heat recovery do not have a high pressure, but they are subjected to double reheat, so they still have a high value of enthalpy and a high degree of superheat, for example, the sixth extraction has a degree of superheat of 227.6 K, and the degree of superheat of the sixth extraction can reach 491.6 kJ/kg when it is expressed by the value of enthalpy. When these extractions are used for the condensate heat recovery with a relatively lower temperature, the exergy loss in the condensate heat recovery process will be significantly increased, thereby increasing the heat consumption of the turbine generator.

The feedwater pump and its front pump are driven by a small steam turbine, which is almost the best choice in the prior art. Generally, the small steam turbine and the deaerator together use the sixth extraction/the fifth extraction, and the exhaust steam enters a main turbine condenser. The small steam turbine is also disclosed to use exhaust steam of the ultra high pressure cylinder. The exhaust steam of the small steam turbine enters the deaerator, and the extraction steam of the small steam turbine is used for a dual-turbine system of the feedwater heat recovery.

The existing double-reheat steam turbine generator typically has a main steam pressure of 33.37 MPa, an exhaust pressure of the ultra high pressure cylinder of 11.22 MPa and an exhaust pressure of the high pressure cylinder of 3.66 MPa. An effective enthalpy drop of the ultra high pressure cylinder is 289.9 kJ/kg, and an effective enthalpy drop of the high pressure cylinder is 337.7 kJ/kg, and the sum of effective enthalpy drops of the intermediate pressure cylinder and the low pressure cylinder is 1328 kJ/kg. So, the sum of the effective enthalpy drops of the ultra high pressure cylinder, the high pressure cylinder, the intermediate pressure cylinder and the low pressure cylinder is 1955.6 kJ/kg.

From the perspective of thermal economy, under the main steam pressure used in the prior art, the primary reheat pressure and the secondary reheat pressure used in the prior art are both high. An exhaust steam temperature of the ultra high pressure cylinder and an exhaust steam temperature of the high pressure cylinder are generally within 415-450° C., which limits the heat absorption capacity of a primary reheating system and a secondary reheating system. In addition, the total mass flow of reheated extraction steam for feedwater heat recovery and condensate heat recovery accounts for about 31.5% of the main steam flow. The second, third, fourth, fifth, sixth, seventh, eighth, ninth and tenth extractions still have strong ability to exert effect, however, they are inefficiently used for the feedwater heat recovery and the condensate heat recovery, and thus lost their opportunity to transform into effective shaft power.

A typical boiler exhaust gas waste heat utilization system in the prior art is a two-stage flue gas waste heat utilization system, that is, a low-temperature economizer is arranged before and after the electric precipitator, respectively, and part/all the condensed water is used to cool the flue gas to obtain 25K to 30K from exhaust gas waste heat. However, the limitation is that a wall temperature of the low-temperature economizer with a lowest operating temperature is usually not less than a flue gas acid dew point minus 10K. If the heat absorbed by this part of the condensed water is not counted into the input heat of the heat balance diagram of the steam turbine system, and can be considered as an additional gain. A certain stage extraction steam is squeezed out, thereby obtaining the heat consumption benefit of about 60 kJ/kWh.

The wet desulfurization system has become a standard configuration of the thermal power generator. A temperature of the net flue gas coming out from an absorption tower is positively related to a temperature of the original flue gas entering the absorption tower, that is, when the temperature of the original flue gas entering the absorption tower drops to 50° C., the temperature of the net flue gas coming out from the absorption tower is about 46° C., which is still within a temperature range (generally between 42° C. and 58° C.) for the main desulfurization reaction. Part of the water vapor in the original flue gas has condensed, which helps to maintain the water balance of the desulfurization tower, thereby significantly reducing the water consumption of the desulfurization process.

In the double-reheat power generator instead of the primary reheat power generator, specific volume of the inlet and exhaust steam of the intermediate pressure cylinder thereof is greatly increased, and the volume flow thereof is more than twice that of the primary reheat power generator with the same output. It is common in the prior art that an intermediate pressure cylinder in a power generator with a capacity greater than 1000 MW is split into two double-flow intermediate pressure cylinders.

When the secondary reheat temperature is constant, an exhaust steam humidity of a last stage blade of the low pressure cylinder is related to the secondary reheat pressure. In order to prevent the exhaust steam humidity of the last stage blade of the low pressure cylinder from entering the Wilson zone, a lower secondary reheat pressure is avoided in the prior art. That is, the exhaust steam humidity of the last stage blade of the low pressure cylinder is used to reversely define the secondary reheat pressure, thereby significantly reducing the effective enthalpy drop of the high pressure cylinder and limiting the heat absorption of the secondary reheating system.

Therefore, there is a need to control the inlet pressure of the low pressure cylinder not to exceed 0.5 MPa and the temperature not to exceed 400° C., whereby, compared to the primary reheat power generator, the inlet specific volume of the low pressure cylinder steam is significantly increased, and the intermediate-low pressure connecting pipe and the inlet chamber of the low pressure cylinder are significantly enlarged.

SUMMARY

The technical problems to be solved are described as follows.

1) A main steam pressure is significantly increased to 40 MPa; a primary reheat steam pressure is significantly increased to 14 MPa, and a secondary reheat steam pressure is significantly increased to 3.5 MPa.

2) A feedwater high pressure heater is improved by increasing its stages from three stages to four stages. A feedwater temperature is greatly increased from 303° C. to 340° C. There is no need to use a separate steam cooler.

3) The air preheater has an ability to increase an inlet air temperature of an air-heater by 80K, so as to raise the flue gas temperature at the outlet of the air-heater, which can raise the water temperature at the outlet of the ultra-low temperature economizer to 150° C., thereby greatly reduces the steam consumption of the deaerator.

4) The additional heat recovery turbine stages of the ultra high pressure cylinder no longer supply steam to the deaerator. Instead, the additional heat recovery turbine stages of the high-intermediate pressure cylinder supply steam to the deaerator and the air preheater, which effectively increases the heat absorption of the primary reheat system and reduces the heat consumption of the double-reheat power generator.

5) Under the conditions that the secondary reheated steam pressure is 3.5 MPa and the secondary reheated steam temperature is 620° C., the design back pressure is reduced to 3.5 kPa.

6) Based on the above technical solutions, the technical problem to be solved is how to significantly reduce the heat consumption of the double-reheat power generator.

The technical solutions of the present application are described as follows.

The present application aims to provide a double-reheat power generator with an ultra high pressure cylinder and a high-intermediate pressure cylinder each having additional heat recovery turbine stages, which has a steam temperature grade of 585° C./620° C./620° C. and can significantly reduce the heat consumption of the double-reheat power generator.

The double-reheat power generator with the ultra high pressure cylinder and the high-intermediate pressure cylinder each having additional heat recovery turbine stages inherits an overall layout of a single-shaft, four cylinders and four exhaust steams. The ultra high pressure cylinder which is single-flow with four stages of feedwater heat recovery and steam extraction can supply steam to four high pressure heaters, so as to raise the water temperature to 340° C., and there is no separate steam coolers. The high-intermediate pressure cylinder which is dual-flow and provided with additional heat recovery turbine stages at its one side can supply steam to the deaerator and the air preheater, respectively. The drainage of the air preheater is pumped into the deaerator by a pump. The double-reheat power generator further comprises two intermediate-low pressure cylinders which are dual-flow without an intermediate pressure cylinder and without intermediate-low pressure connecting pipes. There are no steam extraction ports on main flow paths of the high-intermediate pressure cylinder and the intermediate-low pressure cylinder. Four high pressure heaters are provided with steam by a first extraction, a new second extraction, a new third extraction and a new fourth extraction. The additional heat recovery turbine stages of the ultra high pressure cylinder no longer supply steam to the deaerator. Instead, the additional heat recovery turbine stages of the high-intermediate pressure cylinder supply steam to the deaerator and the air preheater, which effectively increases the heat absorption of the primary reheat system. The condensate is heated to 150° C. by the ultra-low temperature economizer, and all of the low pressure heaters are cancelled.

A double-reheat power generator with an ultra high pressure cylinder and a high-intermediate pressure (HP-IP) cylinder each having additional heat recovery turbine stages, comprising:

a boiler water wall and an economizer;

a boiler superheater system;

the ultra high pressure cylinder having additional heat recovery turbine stages;

a boiler primary reheater system;

the HP-IP cylinder having additional heat recovery turbine stages;

a boiler secondary reheater system;

an intermediate-low pressure (IP-LP) cylinder;

an airpreheater;

an air preheater drainage pump;

a condenser;

a condensate pump;

an ultra-low temperature economizer;

a deaerator;

an electric feedwater pump;

a fourth high pressure heater;

a third high pressure heater;

a second high pressure heater; and a first high pressure heater;

wherein the ultra high pressure cylinder having additional heat recovery turbine stages comprises all-pressure-stage impellers, nozzles, steam distribution mechanisms of the ultra high pressure cylinder; a steam exhaust hood of the ultra high pressure cylinder becomes a large extraction steam opening; five short-blade pressure stages are newly added after the steam exhaust hood; and divided steam continues to expand and exert effect in the newly-added pressure stages, and then is output, with a low degree of superheat and a low value of enthalpy, from a new second extraction, a new third extraction and a new fourth extraction, respectively;

steam exhaust of the ultra high pressure cylinder having additional heat recovery turbine stages, as a first extraction, supplies steam to the first high pressure heater; the new second extraction of the ultra high pressure cylinder having additional heat recovery turbine stages supplies steam to the second high pressure heater; the new third extraction of the ultra high pressure cylinder having additional heat recovery turbine stages supplies steam to the third high pressure heater; and the new fourth extraction of the ultra high pressure cylinder having additional heat recovery turbine stages supplies steam to the fourth high pressure heater;

a new fifth extraction of the HP-IP cylinder having additional heat recovery turbine stages supplies steam to the deaerator; and a new sixth extraction of the HP-IP cylinder having additional heat recovery turbine stages supplies steam to the air preheater;

the air preheater drainage pump is configured to pump drainage water of the air preheater to the deaerator;

an inlet steam pressure of the ultra high pressure cylinder having additional heat recovery turbine stages is 40 MPa; and an exhaust steam pressure of the ultra high pressure cylinder having additional heat recovery turbine stages is 15 MPa;

an inlet steam pressure of the HP-IP cylinder having additional heat recovery turbine stages is 14 MPa; and an exhaust steam pressure of the HP-IP cylinder having additional heat recovery turbine stages is 3.78 MPa;

an inlet steam pressure of the IP-LP cylinder is 3.5 MPa; and an exhaust steam pressure of the IP-LP cylinder is 3.5 kPa;

a pressure of the new fifth extraction of the HP-IP cylinder having additional heat recovery turbine stages is 1.22 MPa; and a temperature of the new fifth extraction of the HP-IP cylinder having additional heat recovery turbine stages is 255° C.;

a pressure of the new sixth extraction of the HP-IP cylinder having additional heat recovery turbine stages is 0.3 MPa; and a temperature of the new sixth extraction of the HP-IP cylinder having additional heat recovery turbine stages is 133.5° C.; and there is a slight humidity; and the air preheater is able to increase an inlet air temperature of an air-heater by 80K to 100 K; and condensate water side outlet design temperature of the ultra-low temperature economizer is 150° C.

The present application has the following beneficial effects.

1) The new sixth extraction provided by the high-intermediate pressure cylinder each having additional heat recovery turbine stages has a pressure of 0.3 MPa and a temperature of 133.5° C., and there is a slight humidity, so the air preheater is able to increase an inlet air temperature of an air-heater by 80K to 100 K, so as to raise the flue gas temperature at the outlet of the air-heater, which can raise the water temperature at the outlet of the ultra-low temperature economizer to 150° C., thereby greatly benefits the reduction of the heat consumption of the power generator.

2) The new fifth extraction provided by the high-intermediate pressure cylinder each having additional heat recovery turbine stages has a pressure of 1.22 MPa and a temperature of 255° C. When the water temperature at the outlet of the ultra-low temperature economizer is increased to 150° C., steam consumption is significantly reduced, and the amount of work done by the new fifth extraction per unit mass in the double-reheat power generator significantly increases, which helps to reduce the heat consumption of the double-reheat power generator.

3) The new second, new third and new fourth extractions with a relatively lower value of enthalpy and a relatively lower degree of superheat are used to replace the second, third, fourth, fifth and sixth extractions with a relatively higher value of enthalpy and a relatively higher degree of superheat of the existing high pressure cylinder and the existing intermediate pressure cylinder, which significantly increases the output power of the power generator, reduces the heat consumption of the power generator, improve the operational safety and have obvious thermal economic benefits.

4) A set of U-shaped heat transfer tubes of the high pressure heater usually has three zones: a superheated steam cooling zone, a condensation heat release zone and a drainage cooling zone. The heat transfer coefficient of the condensation heat release zone is significantly higher than that of the superheated steam. The lower the degree of superheat of the inlet steam of the high pressure heater, the smaller the size of the high pressure heater with the same feedwater temperature rise, and the lower the cost. Four or five high pressure heaters gathered with two or three separate steam coolers are optimized as four high pressure heaters, and thus the capital investment is greatly reduced, and higher feedwater temperature can be obtained.

5) The lower the degree of superheat of the inlet steam of the high pressure heater, the smaller the thermal stress of the tube sheet of the high pressure heater, and the less the thermal fatigue, which is beneficial to the long-term safe operation of the high pressure heater.

6) The lower the inlet steam temperature of the high pressure heater, the higher the allowable stress of the shell made of the same material and the lower the cost.

7) The pipeline connected to the high pressure heater system is reduced because the number of the high pressure heaters is reduced and a working temperature is lowered, so the investment amount is significantly decreased.

8) The separate steam cooler is abandoned, and the method of greatly increasing the exhaust pressure of the ultra high pressure cylinder is used, so as to increase the feedwater temperature to 340° C., which significantly reduces the heat consumption of the double-reheat power generator and improves the reliability of the high pressure heater system.

9) Since the degree of superheat of the new fourth extraction is greatly reduced, it is possible to use the control to the opening degree of the inlet steam shutoff valve of the fourth high pressure heater to improve the load transient response capability of the main steam turbine, instead of using the energy-consuming schemes, i.e., main steam turbine speed control valve pre-throttling or main steam turbine overload supplementary steam valve, which reduces the heat consumption during the operation of the double-reheat power generator and changes the situation that the double-reheat power generator with the throttling adjustment mode has poor ability of frequency regulation.

10) "A wall temperature of the low-temperature economizer with a lowest operating temperature is not less than a flue gas acid dew point minus 10K" is a consensus for those skilled in the art, however, the ultra-low temperature economizer overcomes such technical bias, and creates a new pattern by using the latent heat of vaporization carried by water vapor in the flue gas and with a partial pressure as high as 10-15 kPa.

11) The condensate inlet temperature of the ultra-low temperature economizer is as low as 26.7° C., which is much lower than the acid dew point of the flue gas. The ultra-low temperature economizer is arranged between the induced draft fan and the desulfurization absorption tower, which can cool the flue gas to 50° C. and greatly reduce the process water consumption in the desulfurization system. At the same time, nearly half of the heat of vaporization of the water vapor contained in the flue gas is released, and the heat of hydration from the generation of sulfuric acid is also absorbed by the low-temperature condensate.

12) Compared to the existing low temperature economizer and the existing low-and-low temperature economizer, the ultra-low temperature economizer does not squeeze out part of a certain stage extraction steam, but completely replaces the low-pressure heater. The water side resistance of the ultra-low temperature economizer is much smaller than the sum of the water side resistance of four or five low pressure heaters. The shaft power of the condensate pump is significantly reduced, and there is no power consumption such as a booster pump. Because the temperature of the flue gas entering the desulfurization tower is significantly reduced, the process water consumption is greatly reduced, and the volume flow of the flue gas is significantly reduced, and the power consumption of the induced draft fan is significantly reduced, and the power supply heat consumption of the power generator will drop more.

13) When the high-efficiency ultra-supercritical double-reheat power generator with a large capacity adopts the high speed variable frequency electric feedwater pump (medium frequency variable frequency asynchronous motor drive or high-speed variable frequency synchronous motor drive), there is obvious energy saving and emission reduction benefits. The power generation heat consumption decreased by about 3.2%, and the power supply heat consumption decreased by about 0.4%.

14) The front stage of the intermediate pressure cylinder is merged into the high pressure cylinder and is named as "high-intermediate pressure cylinder". The latter stage of the intermediate pressure cylinder is merged into the low pressure cylinder and is named as the "intermediate-low pressure cylinder". The intermediate-low pressure connecting pipe is eliminated, so the shaft length is significantly shortened, and a single-shaft double-reheat power generator with a capacity of 1200 MW or greater can be built.

15) The intermediate-low pressure connecting pipes are cancelled, so as to reduce flow resistance loss of nearly 9 kPa in the intermediate-low pressure connecting pipes, the steam extraction of the intermediate pressure cylinder and the steam intake of the low pressure cylinder, thereby reducing the heat consumption of the double-reheat power generator.

16) The extraction port of the high-intermediate pressure cylinder is cancelled, which can simplify the structure of the high-intermediate pressure cylinder, thereby further improving the efficiency of the high-intermediate pressure cylinder and reducing the risk of the water shock in the high-intermediate pressure cylinder.

17) By using the scheme of 585° C./620° C./620° C., it is easier to achieve the goal that the design maximum working pressure of the ultra high pressure cylinder is 40 MPa.

BRIEF DESCRIPTION OF THE DRAWINGS

FIG. 1*s* a principle thermal system diagram of a double-reheat power generator with an ultra high pressure cylinder and a high-intermediate pressure cylinder each having additional heat recovery turbine stages; in which:

1, boiler water wall and economizer;
2, boiler superheater system;
3, ultra high pressure cylinder having additional heat recovery turbine stages;
4, boiler primary reheating system;
5, high-intermediate pressure cylinder having additional heat recovery turbine stages;
6, boiler secondary reheating system;
7, intermediate-low pressure cylinder;
8, air preheater;
9, air preheater drainage pump;
10, condenser;
11, condensate pump;
12, ultra-low temperature economizer;
13, deaerator;
14, electric feedwater pump;
15, fourth high pressure heater;
16, third high pressure heater;
17, second high pressure heater; and
18, first high pressure heater.

DETAILED DESCRIPTION OF EMBODIMENTS

The present application will be further described below with reference to the drawing to illustrate a preferred embodiment, in which a double-reheat power generator has a 1000 MW grade and design values of main steam temperature/primary reheated steam temperature/secondary reheated steam temperature of turbine sides are respectively 585° C./620° C./620° C.

Provided herein is a double-reheat power generator with an ultra high pressure cylinder and a high-intermediate pressure (HP-IP) cylinder each having additional heat recovery turbine stages, including: a boiler water wall and an economizer (1), a boiler superheater system (2), the ultra high pressure cylinder having additional heat recovery turbine stages (3), a boiler primary reheater system (4), the high-intermediate pressure cylinder having additional heat recovery turbine stages (5), a boiler secondary reheater system (6), an intermediate-low pressure (IP-LP) cylinder (7), an air preheater (8), an air preheater drainage pump (9), a condenser (10), a condensate pump (11), an ultra-low temperature economizer (12), a deaerator (13), an electric feed water pump (14), a fourth high pressure heater (15), a third high pressure heater (16), a second high pressure heater (17) and a first high pressure heater (18).

The ultra high pressure cylinder having additional heat recovery turbine stages (3) includes all-pressure-stage impellers, nozzles, steam distribution mechanisms; a steam exhaust hood of the ultra high pressure cylinder becomes a large extraction steam opening; five short-blade pressure stages are newly added after the steam exhaust hood; divided steam continues to expand and exert effect in the newly-added pressure stages and then is output from a new second extraction port, a new third extraction port and a new fourth extraction port respectively with a low degree of superheat and a low value of enthalpy.

Steam exhaust of the ultra high pressure cylinder having additional heat recovery turbine stages (3), as a first extraction, supplies steam to the first high pressure heater (18); the new second extraction of the ultra high pressure cylinder having additional heat recovery turbine stages (3) supplies steam to the second high pressure heater (17); the new third extraction of the ultra high pressure cylinder having additional heat recovery turbine stages (3) supplies steam to the third high pressure heater (16); and the new fourth extraction of the ultra high pressure cylinder having additional heat recovery turbine stages (3) supplies steam to the fourth high pressure heater (15).

A new fifth extraction of the high-intermediate pressure cylinder having additional heat recovery turbine stages (5) supplies steam to the deaerator (13); and a new sixth extraction of the high-intermediate pressure cylinder having additional heat recovery turbine stages (5) supplies steam to the air preheater (8).

The air preheater drainage pump (9) is configured to pump drainage water of the air preheater (8) to the deaerator (13).

An inlet steam pressure of the ultra high pressure cylinder having additional heat recovery turbine stages (3) is 40 MPa; and an exhaust steam pressure of the ultra high pressure cylinder having additional heat recovery turbine stages (3) is 15 MPa.

An inlet steam pressure of the high-intermediate pressure cylinder having additional heat recovery turbine stages (5) is 14 MPa; and an exhaust steam pressure of the high-intermediate pressure cylinder having additional heat recovery turbine stages (5) is 3.78 MPa.

An inlet steam pressure of the IP-LP cylinder (7) is 3.5 MPa; and an exhaust steam pressure of the IP-LP cylinder (7) is 3.5 kPa.

A pressure of the new fifth extraction of the high-intermediate pressure cylinder having additional heat recovery turbine stages (5) is 1.22 MPa; and a temperature of the new fifth extraction of the high-intermediate pressure cylinder having additional heat recovery turbine stages (5) is 255° C.

A pressure of the new sixth extraction of the high-intermediate pressure cylinder having additional heat recovery turbine stages (5) is 0.3 MPa; a temperature of the new sixth extraction of the high-intermediate pressure cylinder having additional heat recovery turbine stages (5) is 133.5° C.; and there is a slight humidity; the air preheater (8) is able to increase an inlet air temperature of an air-heater by 80K to 100 K; and condensate water side outlet design temperature of the ultra-low temperature economizer (12) is 150° C.

The ultra high pressure cylinder having additional heat recovery turbine stages (3) is single-flow, has tangential full-arc admission, and all consist of impulse turbine stages.

A main flow part of the ultra high pressure cylinder having additional heat recovery turbine stages (3) includes an inner cylinder and an outer cylinder, consists of seven-stage impulse turbine stages or eight-stage impulse turbine stages; the inner cylinder of the ultra high pressure cylinder having additional heat recovery turbine stages (3) adopts shrunk-on rings to provide a sealing force of a split face; and the inner cylinder of the ultra high pressure cylinder having additional heat recovery turbine stages (3) has a design maximum working pressure of 40 MPa, and does not have a steam extraction port and an overload supplementary steam valve inlet.

The additional heat recovery turbine stages that provides the new second extraction, the new third extraction and the new fourth extraction have a single-layer cylinder structure, and consist of a Z1 stage, a Z2 stage, a Z3 stage, a Z4 stage and a Z5 stage; a steam extraction port after the Z1 stage provides the new second extraction; steam extraction ports after the Z2 stage and the Z3 stage provide the new third extraction; and steam extraction ports after the Z4 stage and the Z5 stage provide the new fourth extraction.

An amount of extraction steam of the new second extraction matches an amount of condensation steam required by the second high pressure heater; the amount of the condensation steam required by the second high pressure heater is able to heat feedwater flowing through the second high pressure heater to a saturation temperature under a pressure of the second high pressure heater at its shell side; and a pressure of the new second extraction is 105% of the pressure of the second high pressure heater at its shell side.

An amount of extraction steam provided by the new third extraction matches an amount of condensation steam required by the third high pressure heater; the amount of the condensation steam required by the third high pressure heater is able to heat feedwater flowing through the third high pressure heater to a saturation temperature under a pressure of the third high pressure heater at its shell side; and a pressure of the new third extraction is 105% of the pressure of the third high pressure heater at its shell side;

An amount of extraction steam provided by the new fourth extraction matches an amount of condensation steam required by the fourth high pressure heater; the amount of the condensation steam required by the fourth high pressure heater is able to heat feedwater flowing through the fourth high pressure heater to a saturation temperature under a pressure of the fourth high pressure heater at its shell side; and a pressure of the new fourth extraction is 105% of the pressure of the fourth high pressure heater at its shell side.

An automatic main valve and a speed control valve are arranged on both sides of the ultra high pressure cylinder and are connected to steam inlets on both sides of the ultra high pressure cylinder; and materials of the automatic main valve, the speed control valve, and a rotor, a steam inlet chamber and the inner cylinder of the ultra high pressure cylinder are selected according to a working temperature of 600° C.

The high-intermediate pressure cylinder having additional heat recovery turbine stages (5) is dual-flow, has tangential full-arc admission, and includes impulse turbine stages.

The high-intermediate pressure cylinder having additional heat recovery turbine stages (5) includes an inner cylinder and an outer cylinder, consists of 2×7-stage impulse turbine stages or 2×8-stage impulse turbine stages which forms a main flow part of the high-intermediate pressure cylinder without a steam extraction port; the additional heat recovery turbine stages including a zz1 stage, a zz2 stage and a zz3 stage are provided on one side of the main flow part; the deaerator (13) is supplied with steam after the zz1 stage; and the air preheater (8) is supplied with steam after the zz3 stage.

Steam inlet combined valves of the high-intermediate pressure cylinder are arranged on two sides of the high-intermediate pressure cylinder and are connected directly to steam inlets on the two sides of the high-intermediate pressure cylinder; and materials of the steam inlet combined valves, and the rotor, the inner cylinder and the steam inlet chamber of the high-intermediate pressure cylinder are selected according to a working temperature of 620° C.

The intermediate-low pressure cylinder (7) includes two intermediate-low pressure cylinders, is dual-flow and has four steam exhaust ports; four steam inlet combined valves of the intermediate-low pressure cylinder are divided into two groups, which are arranged on two sides of steam inlet parts of the two intermediate-low pressure cylinders; the intermediate-low pressure cylinder (7) has tangential full-arc admission and includes an inner layer, a middle layer and an outer layer which forms a three-layered cylinder structure; the intermediate-low pressure cylinder consists of 2×2×8 stage impulse turbine stages without steam extraction ports; the inner layer is a high temperature steam inlet chamber; the middle layer is a low pressure inner cylinder and the outer layer is a low pressure outer cylinder; an outlet of a boiler high temperature secondary reheater is provided with four secondary reheat hot section pipes, which are respectively connected to the four steam inlet combined valves of the intermediate-low pressure cylinder; and materials of the steam inlet combined valves, the rotor, the inner cylinder and the high temperature steam inlet chamber of the intermediate-low pressure cylinder are selected according to a working temperature of 620° C.

The ultra-low temperature economizer (12) includes H-shaped fin tubes in series to form a serpentine tube; a base pipe is arranged horizontally; the H-shaped fin tubes are vertically arranged; a low temperature condensate water enters a side of a bottom of the serpentine tube through an inlet header of the ultra-low temperature economizer (12), and then flows upward along the serpentine pipe; and a flue gas flows from top to bottom to form countercurrent heat transfer.

A serpentine group includes several serpentine tubes which are connected in parallel through the inlet header and an outlet header of the ultra-low temperature economizer (12) to form A/B groups of the ultra-low temperature economizer (12), which are respectively arranged on A/B sides of a low dust flue.

Through full flow of condensate water, the pressure drop of the ultra-low temperature economizer (12) does not exceed 200 kPa; a countercurrent arrangement is divided into a hot section and a cold section; a part of base tube where a wall temperature thereof is not less than a flue gas acid dew point minus 10K is the hot section that is made of 09CrCuSb (ND steel); a part of the base tube where the wall temperature thereof is below the flue gas acid dew point minus 10K is the cold section that is made of duplex stainless steel and applied with a polytetrafluoroethylene coating having a thickness of 0.02 mm.

A shell and an expansion joint of the ultra-low temperature economizer (12) are made of ND steel and covered with an anticorrosive layer made of glass fiber reinforced plastics; and a design outlet condensate water temperature of the ultra-low temperature economizer (12) is 150° C., and a design life of the ultra-low temperature economizer (12) is 30 years.

What is claimed is:

1. A double-reheat power generator with an ultra high pressure cylinder and a high-intermediate pressure (HP-IP) cylinder each having additional heat recovery turbine stages, comprising:

a boiler water wall and an economizer;

a boiler superheater system;

the ultra high pressure cylinder having additional heat recovery turbine stages;

a boiler primary reheater system;

the HP-IP cylinder having additional heat recovery turbine stages;

a boiler secondary reheater system;

an intermediate-low pressure (IP-LP) cylinder;

an air preheater;

an air preheater drainage pump;

a condenser;

a condensate pump;

an ultra-low temperature economizer;

a deaerator;

an electric feedwater pump;

a fourth high pressure heater;

a third high pressure heater;

a second high pressure heater; and a first high pressure heater;

wherein the ultra high pressure cylinder having additional heat recovery turbine stages comprises all-pressure-stage impellers, nozzles, steam distribution mechanisms of the ultra high pressure cylinder; a steam exhaust hood of the ultra high pressure cylinder becomes a large extraction steam opening; five short-blade pressure stages are newly added after the steam exhaust hood; and divided steam continues to expand and exert effect in the newly-added pressure stages, and then is output, with a low degree of superheat and a low value of enthalpy, from a new second extraction, a new third extraction and a new fourth extraction, respectively;

steam exhaust of the ultra high pressure cylinder having additional heat recovery turbine stages, as a first extraction, supplies steam to the first high pressure heater; the new second extraction of the ultra high pressure cylinder having additional heat recovery turbine stages supplies steam to the second high pressure heater; the new third extraction of the ultra high pressure cylinder having additional heat recovery turbine stages supplies steam to the third high pressure heater; and the new fourth extraction of the ultra high pressure cylinder having additional heat recovery turbine stages supplies steam to the fourth high pressure heater;

a new fifth extraction of the HP-IP cylinder having additional heat recovery turbine stages supplies steam to the deaerator; and a new sixth extraction of the HP-IP cylinder having additional heat recovery turbine stages supplies steam to the air preheater;

the air preheater drainage pump is configured to pump drainage water of the air preheater to the deaerator;

an inlet steam pressure of the ultra high pressure cylinder having additional heat recovery turbine stages is 40 MPa; and an exhaust steam pressure of the ultra high pressure cylinder having additional heat recovery turbine stages is 15 MPa;

an inlet steam pressure of the HP-IP cylinder having additional heat recovery turbine stages is 14 MPa; and an exhaust steam pressure of the HP-IP cylinder having additional heat recovery turbine stages is 3.78 MPa;

an inlet steam pressure of the IP-LP cylinder is 3.5 MPa; and an exhaust steam pressure of the IP-LP cylinder is 3.5 kPa;

a pressure of the new fifth extraction of the HP-IP cylinder having additional heat recovery turbine stages is 1.22 MPa; and a temperature of the new fifth extraction of the HP-IP cylinder having additional heat recovery turbine stages is 255° C.;

a pressure of the new sixth extraction of the HP-IP cylinder having additional heat recovery turbine stages is 0.3 MPa; and a temperature of the new sixth extraction of the HP-IP cylinder having additional heat recovery turbine stages is 133.5° C.; and there is a slight humidity; and the air preheater is able to increase an inlet air temperature of an air-heater by 80K to 100 K; and condensate water side outlet design temperature of the ultra-low temperature economizer is 150° C.

2. The double-reheat power generator with the ultra high pressure cylinder and the HP-IP cylinder each having additional heat recovery turbine stages of claim 1, wherein the ultra high pressure cylinder having additional heat recovery turbine stages is single-flow, has tangential full-arc admission, and all consist of impulse turbine stages;

a main flow part of the ultra high pressure cylinder having additional heat recovery turbine stages comprises an inner cylinder and an outer cylinder, consists of seven-stage impulse turbine stages or eight-stage impulse turbine stages; the inner cylinder of the ultra high pressure cylinder adopts shrunk-on rings to provide a sealing force of a split face; and the inner cylinder of the ultra high pressure cylinder has a design maximum working pressure of 40 MPa, and does not have a steam extraction port and an overload supplementary steam valve inlet;

the additional heat recovery turbine stages that provides the new second extraction, the new third extraction and the new fourth extraction have a single-layer cylinder structure, and consist of a Z1 stage, a Z2 stage, a Z3 stage, a Z4 stage and a Z5 stage; a steam extraction port after the Z1 stage provides the new second extraction; steam extraction ports after the Z2 stage and the Z3 stage provide the new third extraction; and steam extraction ports after the Z4 stage and the Z5 stage provide the new fourth extraction;

an amount of extraction steam of the new second extraction matches an amount of condensation steam required by the second high pressure heater; the amount of the condensation steam required by the second high pressure heater is able to heat feedwater flowing through the second high pressure heater to a saturation temperature under a pressure of the second high pressure heater at its shell side; and a pressure of the new second extraction is 105% of the pressure of the second high pressure heater at its shell side;

an amount of extraction steam provided by the new third extraction matches an amount of condensation steam required by the third high pressure heater; the amount of the condensation steam required by the third high pressure heater is able to heat feedwater flowing through the third high pressure heater to a saturation temperature under a pressure of the third high pressure heater at its shell side; and a pressure of the new third extraction is 105% of the pressure of the third high pressure heater at its shell side;

an amount of extraction steam provided by the new fourth extraction matches an amount of condensation steam required by the fourth high pressure heater; the amount of the condensation steam required by the fourth high pressure heater is able to heat feedwater flowing through the fourth high pressure heater to a saturation temperature under a pressure of the fourth high pressure heater at its shell side; and a pressure of the new fourth extraction is 105% of the pressure of the fourth high pressure heater at its shell side; and an automatic main valve and a speed control valve are arranged on both sides of the ultra high pressure cylinder and are connected to steam inlets on both sides of the ultra high pressure cylinder; and materials of the automatic main valve, the speed control valve, and a rotor, a steam inlet chamber and an inner cylinder of the ultra high pressure cylinder are selected according to a working temperature of 600° C.

3. The double-reheat power generator with the ultra high pressure cylinder and the HP-IP cylinder each having additional heat recovery turbine stages of claim 1, wherein the high-intermediate pressure cylinder having additional heat recovery turbine stages is dual-flow, has tangential full-arc admission, and comprises impulse turbine stages;

the high-intermediate pressure cylinder having additional heat recovery turbine stages comprises an inner cylinder and an outer cylinder, consists of 2×7-stage impulse turbine stages or 2×8-stage impulse turbine stages which forms a main flow part of the high-intermediate pressure cylinder without a steam extraction port; the additional heat recovery turbine stages comprising a zz1 stage, a zz2 stage and a zz3 stage are provided on one side of the main flow part; the deaerator is supplied with steam after the zz1 stage; and the air preheater is supplied with steam after the zz3 stage; and steam inlet combined valves of the high-intermediate pressure cylinder are arranged on two sides of the high-intermediate pressure cylinder and are connected to steam inlets on the two sides of the high-intermediate pressure cylinder; and materials of the steam inlet combined valves, and a rotor, an inner cylinder and a steam inlet chamber of the high-intermediate pressure cylinder are selected according to a working temperature of 620° C.

4. The double-reheat power generator with the ultra high pressure cylinder and the HP-IP cylinder each having additional heat recovery turbine stages of claim 1, wherein the intermediate-low pressure cylinder comprises two intermediate-low pressure cylinders, is dual-flow and has four steam exhaust ports; four steam inlet combined valves of the intermediate-low pressure cylinder are divided into two groups, which are arranged on two sides of steam inlet parts of the two intermediate-low pressure cylinders; the intermediate-low pressure cylinder has tangential full-arc admission and comprises an inner layer, a middle layer and an outer layer which forms a three-layered cylinder structure; the intermediate-low pressure cylinder consists of 2×2×8 stage impulse turbine stages without steam extraction ports; the inner layer is a high temperature steam inlet chamber; the middle layer is a low pressure inner cylinder and the outer layer is a low pressure outer cylinder; an outlet of a boiler high temperature secondary reheater is provided with four secondary reheat hot section pipes, which are respectively connected to the four steam inlet combined valves of the intermediate-low pressure cylinder; and materials of the steam inlet combined valves, a rotor, an inner cylinder and a high temperature steam inlet chamber of the intermediate-low pressure cylinder are selected according to a working temperature of 620° C.

5. The double-reheat power generator with the ultra high pressure cylinder and the HP-IP cylinder each having additional heat recovery turbine stages of claim 1, wherein the ultra-low temperature economizer comprises H-shaped fin tubes in series to form a serpentine tube; a base pipe is arranged horizontally; the H-shaped fin tubes are vertically arranged; a low temperature condensate water enters a side of a bottom of the serpentine tube through an inlet header of the ultra-low temperature economizer, and then flows upward along the serpentine pipe; and a flue gas flows from top to bottom to form countercurrent heat transfer;

a serpentine group includes several serpentine tubes which are connected in parallel through the inlet header and an outlet header of the ultra-low temperature economizer to form A/B groups of the ultra-low temperature economizer, which are respectively arranged on A/B sides of a low dust flue;

through full flow of condensate water, the pressure drop of the ultra-low temperature economizer (12) does not exceed 200 kPa; a countercurrent arrangement is divided into a hot section and a cold section; a part of base tube where a wall temperature thereof is not less than a flue gas acid dew point minus 10K is the hot section that is made of 09CrCuSb (ND steel); and a part of the base tube where the wall temperature thereof is below the flue gas acid dew point minus 10K is the cold section that is made of duplex stainless steel and applied with a polytetrafluoroethylene coating having a thickness of 0.02 mm; and a shell and an expansion joint of the ultra-low temperature economizer are made of ND steel and covered with an anticorrosive layer made of glass fiber reinforced plastics; and a design outlet condensate water temperature of the ultra-low temperature economizer is 150° C., and a design life of the ultra-low temperature economizer is 30 years.

* * * * *